US008042292B2

(12) United States Patent
Gibb et al.

(10) Patent No.: US 8,042,292 B2
(45) Date of Patent: Oct. 25, 2011

(54) CABLE TENSIONING APPARATUS AND METHOD FOR SECURING A SHEET TO A FRAME

(75) Inventors: John D. Gibb, Buford, GA (US); Christopher Jonathan Adams, Hoschton, GA (US)

(73) Assignee: Formetco, Inc., Duluth, GA (US)

( * ) Notice: Subject to any disclaimer, the term of this patent is extended or adjusted under 35 U.S.C. 154(b) by 389 days.

(21) Appl. No.: 12/174,449

(22) Filed: Jul. 16, 2008

(65) Prior Publication Data

US 2009/0019750 A1 Jan. 22, 2009

Related U.S. Application Data

(60) Provisional application No. 60/950,025, filed on Jul. 16, 2007.

(51) Int. Cl.
*G09F 17/00* (2006.01)

(52) U.S. Cl. ..... 40/603; 160/354; 160/370; 160/404

(58) Field of Classification Search ..... 40/603, 40/611.12; 160/354, 370, 378, 404
See application file for complete search history.

(56) References Cited

U.S. PATENT DOCUMENTS

| | | | | |
|---|---|---|---|---|
| 1,474,692 | A | 11/1923 | Thurau | |
| 1,819,776 | A * | 8/1931 | Heck | 359/445 |
| 2,866,249 | A | 12/1958 | Normandin | |
| 4,378,617 | A * | 4/1983 | Burns | 24/336 |
| 4,809,408 | A | 3/1989 | Abrahamson | |
| 5,003,716 | A | 4/1991 | Dyar | |
| 5,178,306 | A | 1/1993 | Petrou | |
| 5,467,546 | A | 11/1995 | Kovalak, Jr. | |
| 6,339,889 | B1 | 1/2002 | Griesemer et al. | |
| 6,789,295 | B1 | 9/2004 | Svensson | |
| 6,991,693 | B2 | 1/2006 | Wylie et al. | |
| 7,168,197 | B2 | 1/2007 | Siegenthaler | |

FOREIGN PATENT DOCUMENTS

| | | |
|---|---|---|
| GB | 2215766 A | 9/1989 |
| JP | 06094010 | 4/1994 |

OTHER PUBLICATIONS

U.S. Appl. No. 60/912,058, filed Apr. 16, 2007.
Search Report and Written Opinion for International Patent Application No. PCT/US2008/070197; Oct. 22, 2008.

* cited by examiner

*Primary Examiner* — Joanne Silbermann
(74) *Attorney, Agent, or Firm* — Jason A. Bernstein; Barnes & Thornburg LLP

(57) ABSTRACT

A cable tensioning system for mounting a vinyl sheet to a billboard frame, comprising a cable secured on a frame at one end and secured to a spring-loaded cable tensioning device at the other end. A plurality of cable guides are mounted at intervals around the frame, each of the cable guides having a channel adapted to receive the cable. Portions of the edges of a sheet are secured within a plurality of locking clips around the perimeter, each clip also having a channel to receive the cable. The sheet with the clips affixed is secured to the frame whereby cable travels through the channels in the locking clips and is guided around the perimeter of the frame by the channel guides and secured to the spring-loaded cable tensioning device. The spring-loaded cable tensioning device is deployed to tighten the cable around the frame and secure the sheet to the frame.

11 Claims, 13 Drawing Sheets

CABLE TENSIONING APPARATUS AND METHOD FOR SECURING A SHEET TO A FRAME

CROSS REFERENCE TO RELATED APPLICATION

This patent application claims the benefit of U.S. Provisional Patent Application No. 60/950,025, filed Jul. 16, 2007, the disclosure of which is incorporated herein by reference in its entirety.

FIELD

The present disclosure relates to a cable tensioning apparatus and method of use thereof to mount sheets of material such as large vinyl sheets to a frame to comprise a billboard or other means for displaying a printed message.

BACKGROUND

The use of billboards or other large-scale displays is a popular way to convey information to the public, whether as an advertisement or public service message on the side of a highway, as a display printed on a side of a vehicle such as a truck, or as an informational message displayed on the side of a building.

Historically, billboards were simple generally flat surfaces upon which written material was placed, for example, by painting or drawing a message intended for public viewing. Messages printed on large paper sheets were pasted on generally flat surfaces, also known as substrates, and subsequent messages were simply pasted over previous ones. As billboards increased in size it became too difficult to print the message on a single large sheet of paper, and thus multiple sheets were used and assembled by a worker onto the billboard.

In recent years printed vinyl sheets have replaced printed paper sheets as a popular medium for large-scale messaging. Vinyl is stronger than paper, more tear resistant, easier to handle, and typically lasts longer than paper. Paper has to be glued to a substrate and generally lasts approximately thirty days before deterioration is noticeable. In addition, instead of requiring multiple smaller sheets, a message can be printed on one large sheet. In conventional methods of mounting such vinyl billboards, a large sheet is draped over a frame and/or a substrate and the four edges are secured so that the message printed on the sheet is displayed.

For example, one conventional method for securing the sheet to the frame is to drape the vinyl sheet over the frame and tie opposing edges together on the back, using rope or cord tied to itself or tied to braces on the back of a substrate. Another method, disclosed in U.S. Pat. No. 7,168,197 to Siegenthaler, uses a series of adjustable J-shaped hooks mounted on clips fastened to the billboard frame, with the J-shaped hooks passing through holes in the vinyl sheet to secure the sheet to the frame. Still another conventional method uses long rods, known as gripper rods or gripper bars, which are inserted into pockets in the four edges of a vinyl sheet created by folding and heat welding the edges of the sheet. After the rod is inserted into the pockets, the sheet is mounted to the frame. One way of mounting such a vinyl sheet is to use J-shaped hooks mounted around the four edges of the billboard, which, like the J-shaped hooks disclosed in Siegenthaler, pass through holes in the vinyl sheet. Another way of mounting a vinyl sheet having a gripper bar is to use a threaded clip that squeezes the gripper bar between two surfaces of the clip. Yet another way is to use a clip having an H-shaped channel, with a locking pin inserted in the bottom of the "H" after the gripper bar is in place.

However, the holes in the vinyl sheets can reduce the overall strength of the sheet, making it susceptible to tearing and uneven tensioning, which in turn can result in sags, folds, or other distortions of the sheet making the message difficult to read. In addition, light-weight vinyl sheets have become popular, which cost less and are more flexible but are thinner and have less strength than heavier sheets, making them less unsuitable for the heat-welding required for installation of gripper bars and generally more susceptible to tearing from the holes required for use of J-hooks. The subject matter cable tensioning apparatus requires no welding, reinforcement, or other treatment of the edge of the media.

SUMMARY

This summary is intended to introduce, in simplified form, a selection of concepts that are further described in the Detailed Description. This summary is not intended to identify or limit key or essential features of the claimed subject matter, nor is it intended to be used as an aid in determining the scope of the claimed subject matter.

Aspects described herein relate to an apparatus and method for mounting a large vinyl or other sheet medium onto an existing flat display substrate or frame, for example, a billboard display typically used in the advertising industry. In one exemplary embodiment, an apparatus is provided which includes a cable tensioning system comprising at least one cable associated with a frame at one location by means of a cable anchor plate, a plurality of edge cable guides to guide the cables around the frame, and a plurality of locking clips that lock onto the sheet medium and rest on the cable to provide additional cable guiding means. In addition, if the frame is rectangular or otherwise polyhedral, the apparatus can include one or more corner cable guides to further guide the cables around the frame. The apparatus further includes two spring-loaded tension devices, each secured to the end of one of the two cables, to tighten and secure the cables to the frame after they have been threaded through the cable guides and locking clips. A long pole having an inverted hook at a distal end can be used to raise and hang the cable on the cable guides. Using an apparatus in accordance with aspects described herein can permit the mounting of a large vinyl sheet to a frame without having to fold or weld the sheet and without having to cut holes which might weaken it. The apparatus can be used for a frame having any shape, including square, rectangular, triangular, round, oval, or other regular or irregular shape, and can also be used to secure a vinyl sheet to a frame and substrate for other uses such as for mounting on the side or back of a vehicle or a building. The apparatus of the present disclosure can also be used in other applications, such as, but not limited to, the context of an artist's frame and canvas, covering an opening, such as a drum, holding tank or the like, and other applications.

BRIEF DESCRIPTION OF THE DRAWINGS

Exemplary embodiments of the present disclosure are illustrated in the drawings in which like reference characters designate the same or similar parts throughout the figures of which.

DETAILED DESCRIPTION

The aspects summarized above can be embodied in various forms. The following description shows, by way of illustration, combinations and configurations in which the aspects can be practiced. It is understood that the described aspects and/or embodiments are merely examples. It is also understood that other aspects and/or embodiments can be utilized, and that structural and functional modifications can be made, without departing from the scope of the present disclosure. For example, although some aspects herein are described in the context of a cable tensioning system used to mount a vinyl sheet forming a rectangular billboard on a frame supporting a substrate, it should be noted that such a configuration is merely exemplary, and that variations can be made without departing from the spirit or scope of aspects herein. For example, materials other than vinyl, such as, but not limited to, paper, fabric, polymer or other plastic, webbing, mesh, net, grid, combinations of the foregoing and the like, can be used for the sheet to be mounted on the frame. Also, a frame according to aspects described herein can have any size or shape such as, but not limited to, a circular, triangular, square, or other polyhedral or irregular shape. In addition, such a frame can be used not only to support a billboard but to support a display of informational or advertising material mounted in other places or other manners such as on a vehicle or a building or a display of purely decorative matter not imparting any information. One skilled in the art would readily recognize that these and other variations can be made without departing from the scope of the present disclosure. For the purposes of the present disclosure a vinyl sheet will be used as an illustrative, nonlimiting example.

Figure 1:
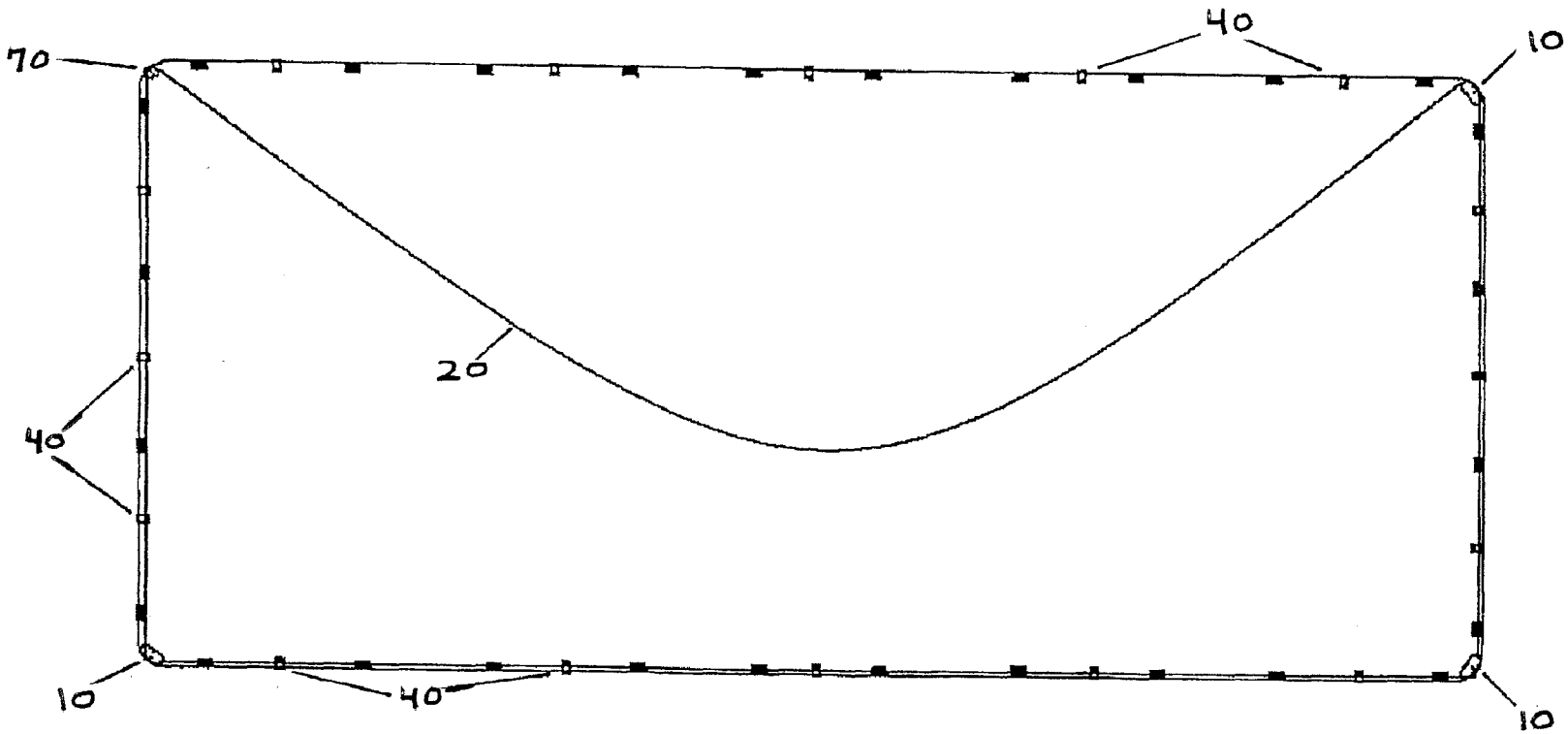
FIG. 1 depicts a cable tensioning system in accordance with aspects described herein.
Figure 2:
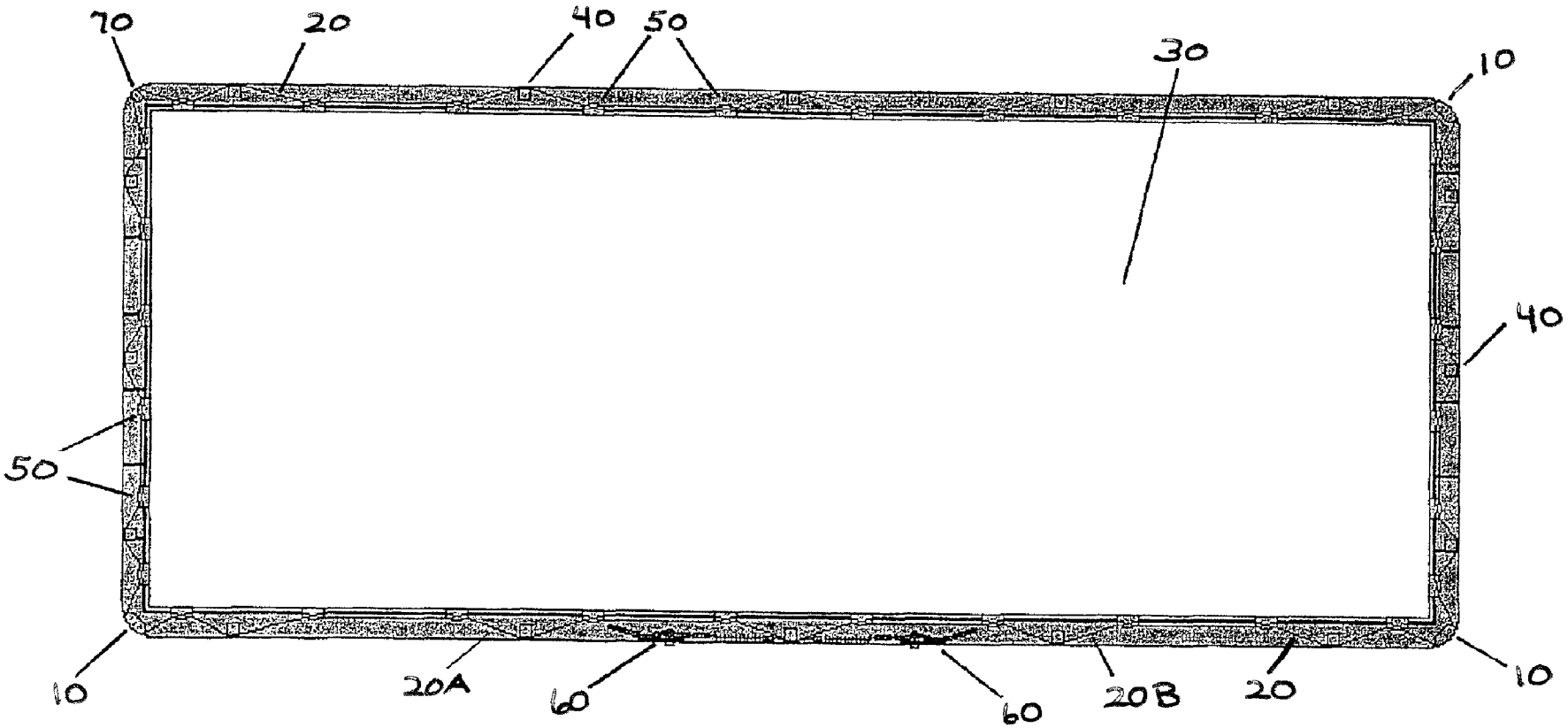
FIG. 2 depicts a cable tensioning system in accordance with aspects described herein after one or more locking clips have been attached to the cable and tension applied using two spring-loaded tension devices.
Figure 6:
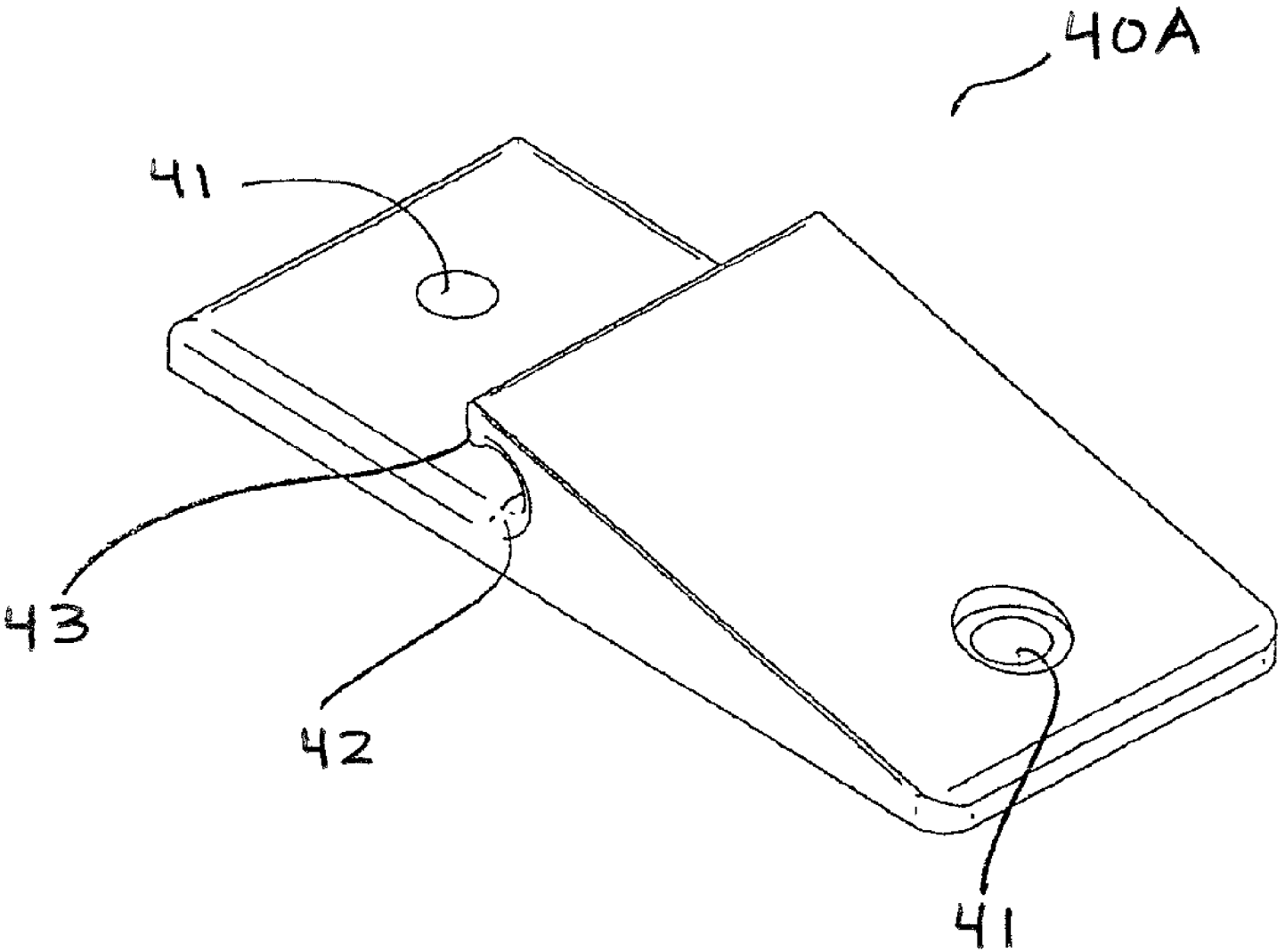
FIG. 6 depicts an exemplary flush-mounted cable guide for use in a cable tensioning system in accordance with aspects described herein.
Figure 7:
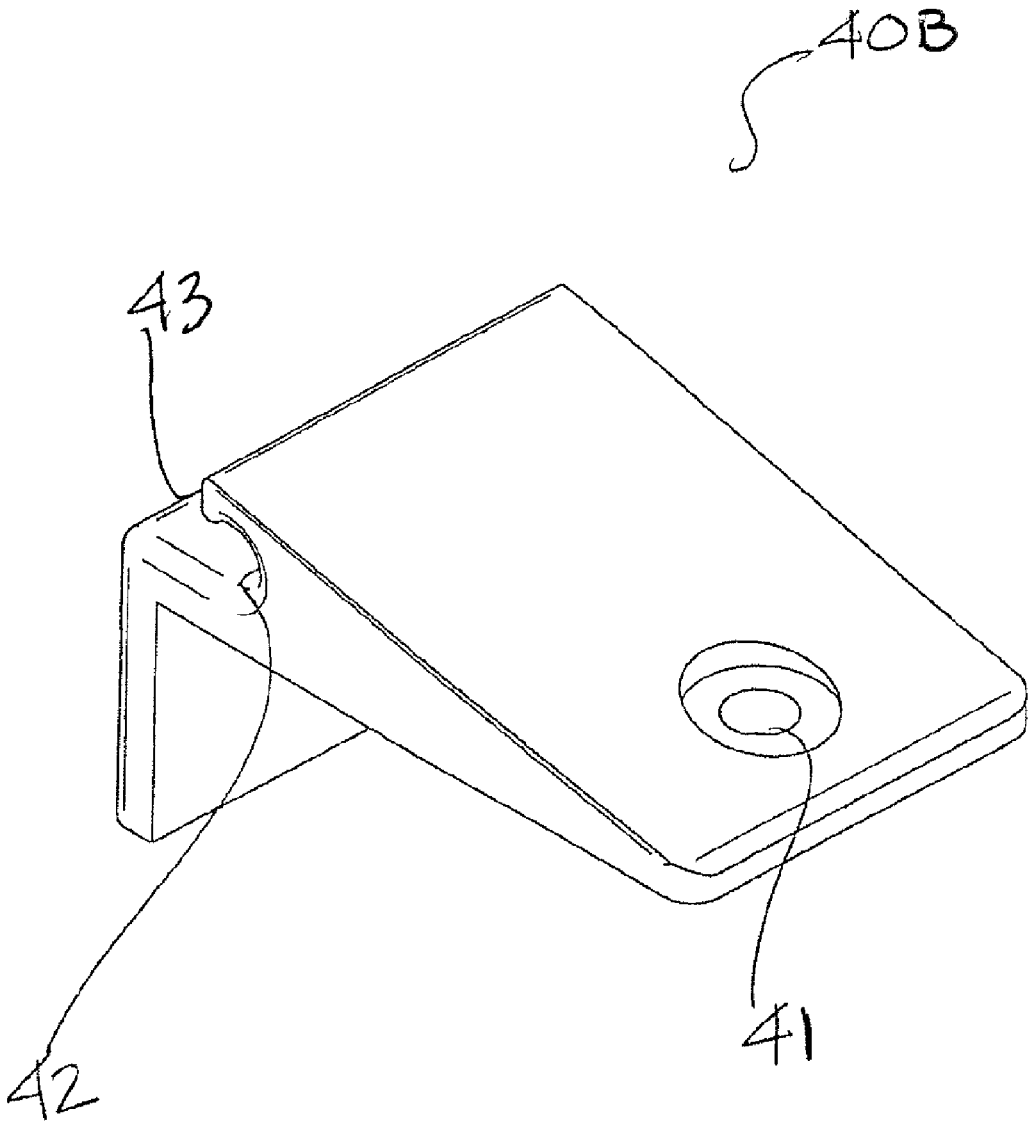
FIG. 7 depicts an exemplary right angle-mounted cable guide for use in a cable tensioning system in accordance with aspects described herein.

Referring to the Figures described above, an exemplary configuration for a cable tensioning system in accordance with one or more aspects described herein is illustrated in FIGS. 1 and 2. As shown in FIG. 1, a cable tensioning system is provided wherein cable 20 is secured by means of cable anchor plate 70 to an upper left-hand corner of a rectangular frame. According to one or more aspects described in more detail herein, cable 20 can be guided through one or more cable guides 40 attached along the edges of a frame and corner cable guides 10 attached at one or more of the other three corners. A cable guide 40 that can be used in a cable tensioning system described herein can be mounted directly to a front edge of a frame or a front of a substrate, i.e., a flush-mounted cable guide 40A as shown in FIG. 6, or can be configured to be attached at a front of the substrate and extend over the top, i.e., be a right-angle mounted cable guide 40B as shown in FIG. 7. In the case of either a flush-mounted cable guide 40A or a right-angle mounted cable guide 40B, a cable 20 can be guided along an upper surface of a channel 42 at the front of the guide. The substrate may be a flat panel or series of panels mounted to the frame against which the sheet 30 can rest. Alternatively, the substrate can be a series of open panels with gaps therebetween. Further alternatively, the frame may optionally not have a substrate structure.

Figure 8:
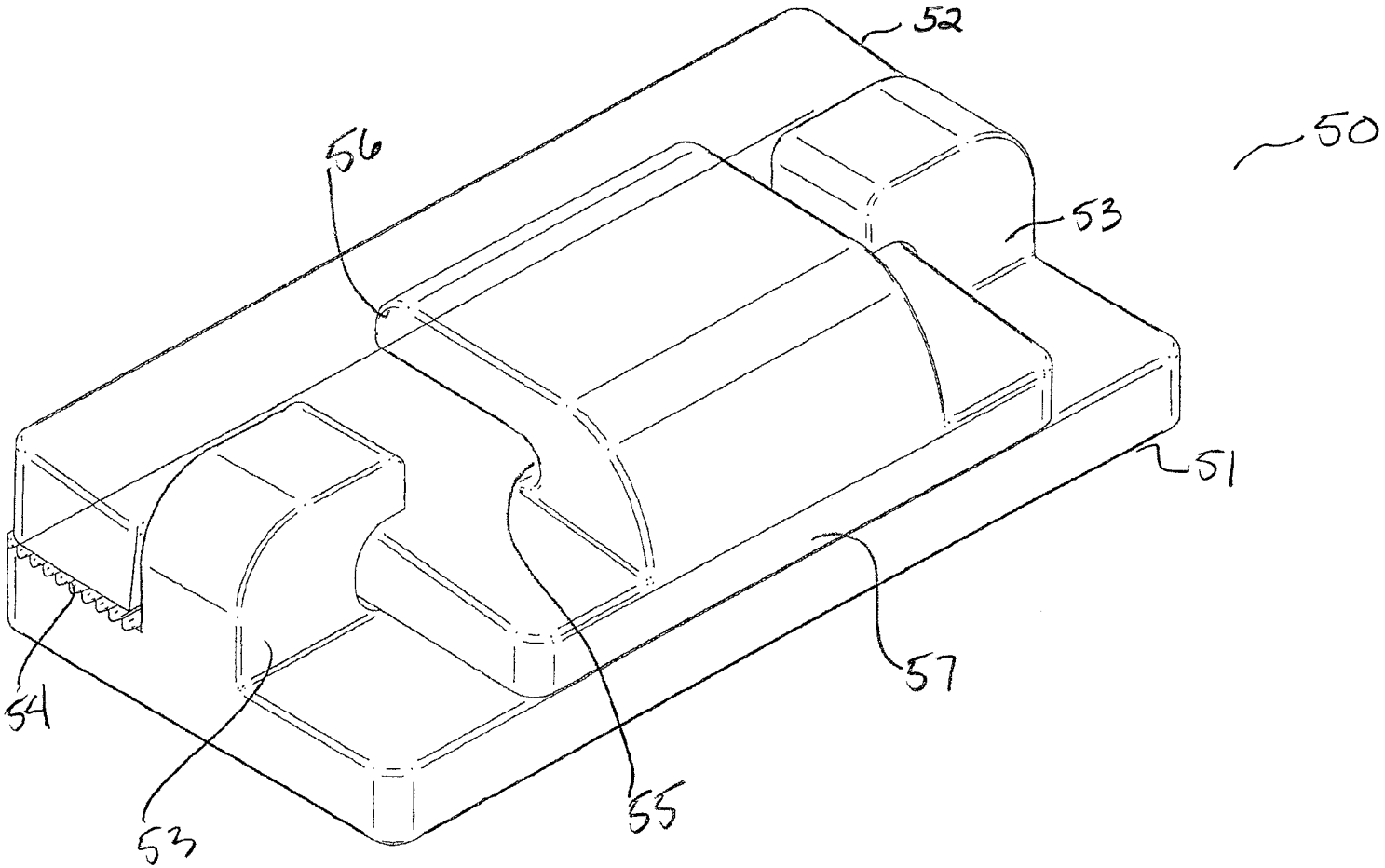
FIG. 8 depicts an exemplary base plate for a two-piece locking clip for use in a cable tensioning system in accordance with aspects described herein.

As shown in FIG. 2, a plurality of cable guides 40 in conjunction with one or more locking clips 50 and spring-loaded tension devices 60 can provide a means to securely hold cable 20 around the perimeter of a frame. In accordance with one or more aspects herein and as described in more detail below, locking clip 50 shown in more detail in FIG. 8 comprises two parts, a locking clip base plate 51 as shown in FIG. 8 and a cable pull top plate 52 shown in FIG. 9. An exemplary locking clip that can be used in a cable tensioning system according to aspects herein and methods of use thereof are described in detail in U.S. patent application Ser. No. 12/104,257, filed on Apr. 16, 2008, by Robert Lee Franklin et al. In accordance with one or more aspects herein and as described in more detail below a sheet medium such as a vinyl sheet containing printed information can be placed on top of locking clip base plate 51. Cable pull top plate 52 can then be placed on top of the vinyl sheet such that ridges 54 on a top surface of base plate 51 in conjunction with cable pull top plate 57 securely hold the vinyl sheet therebetween. As shown in FIG. 2, two cables 20 can be affixed to a corner of a frame holding a substrate for supporting a billboard so that the combined cable 20 extends around the entire perimeter of the frame guided through the channels 55 in cable locking clips 50 and channels 42 in cable guides 40. The end of cable 20 then can be joined to one of spring-loaded tension devices 60 at, for example, the bottom of the frame. The same process can be repeated for the second of the two cables 20 so that cable 20 extends around a perimeter of the frame. When the two spring-loaded tension devices 60 are deployed, cable 20 can be tightened around the frame thereby increasing the tension on cable pull top plate 52 so that locking clips 50 securely hold the sheet medium to the frame and the substrate. It should be noted that two tension devices 60 are not necessarily required in order to apply tension to the cable and that, for example, a smaller size frame may require only one tension device 60 to apply sufficient tension to securely affix a sheet medium to the frame and substrate.

Figure 3:
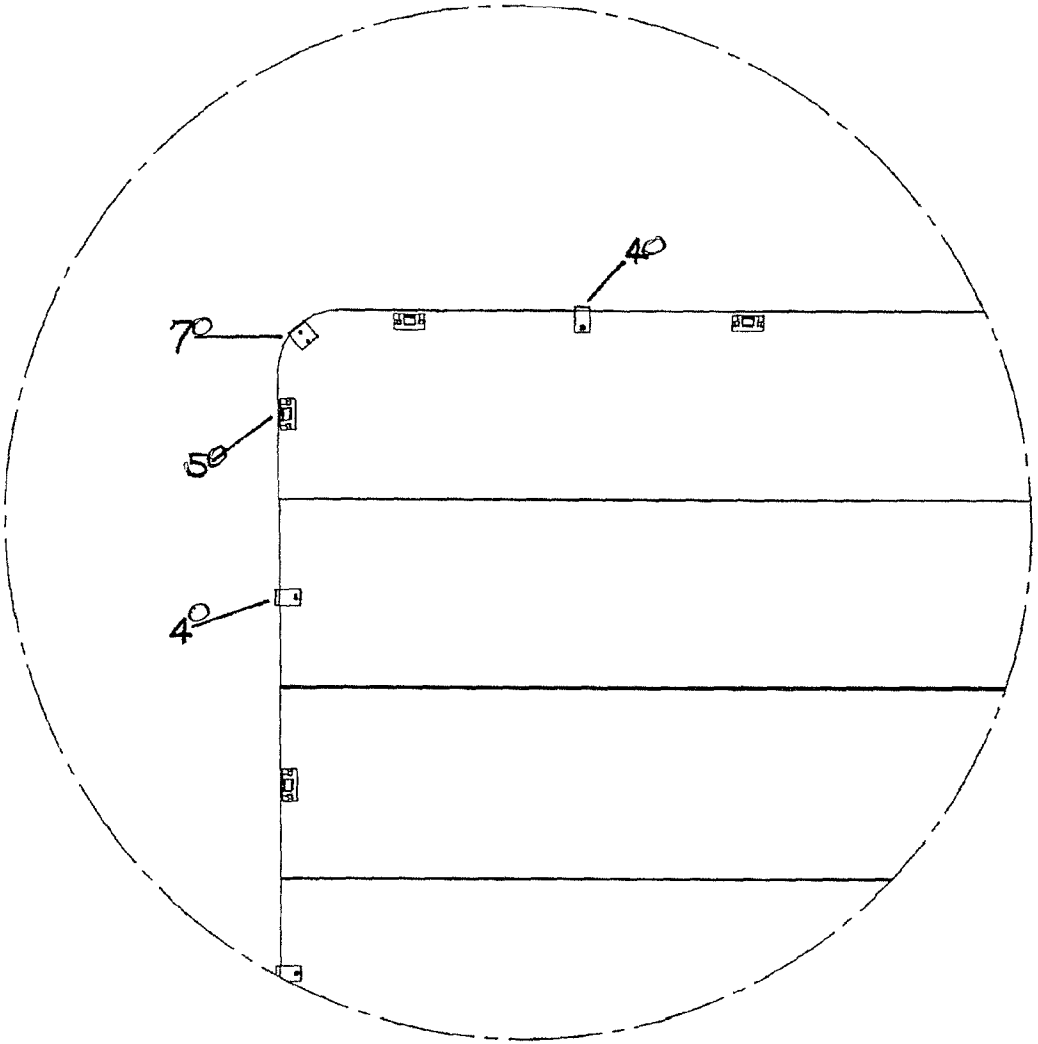
FIG. 3 depicts an exemplary upper corner configuration of a frame and substrate apparatus suitable for use with a cable tensioning system in accordance with aspects described herein.
Figure 12:
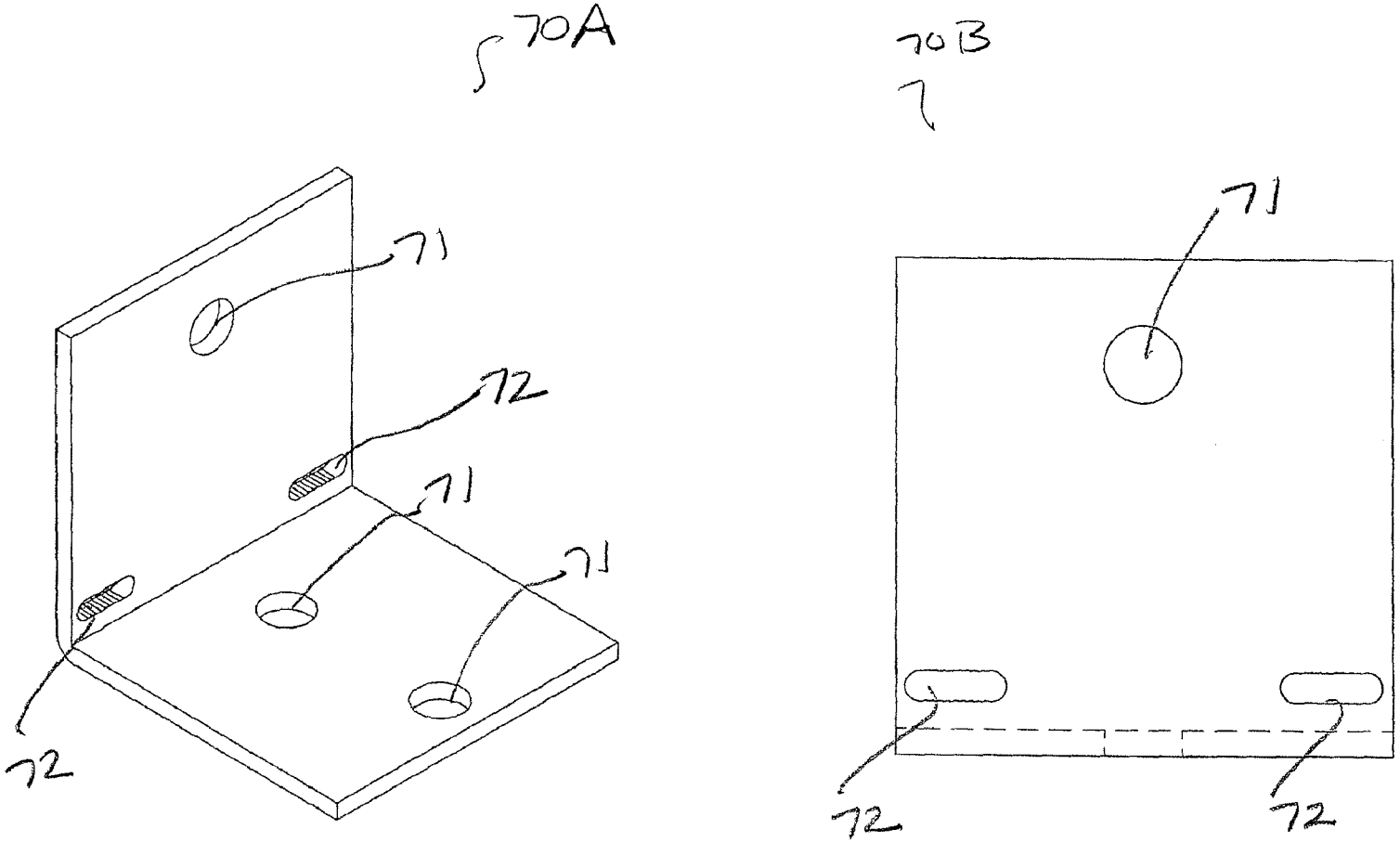
FIG. 12 depicts an exemplary cable anchor plate for use in a cable tensioning system in accordance with aspects described herein.

FIG. 3 depicts a more detailed view of an exemplary frame and apparatus configuration for use with a cable tensioning system in accordance with one or more aspects described herein. As shown in FIG. 3, a cable tensioning system according to aspects herein can be deployed on a rectangular frame having a cable anchor plate 70, shown in more detail in FIG. 12, which can be used to anchor a cable for use in mounting, for example, a vinyl sheet in accordance with aspects described herein. In an exemplary configuration herein, cable anchor plate 70 can anchor two cables 20 joined together at cable anchor plate 70 to extend around a perimeter of a frame. As noted above, cable 20 can be guided around a perimeter by means of one or more cable guides 40 and locking clips 50. In the exemplary configuration shown in FIG. 3, locking clips 50 and cable guides 40 are placed in an alternating configuration such that a locking clip 50 is followed by a cable guide 40. It should be noted, however, that the order in which locking clips 50 and cable guide 40 are shown is only exemplary and that other configurations can be made, for example, starting at the upper left corner shown in FIG. 3, cable guide 40 can be followed by a locking clip 50, multiple locking clips 50 followed by one cable guide 40, or multiple cable guides 40 followed by one locking clip 50.

Figure 4:
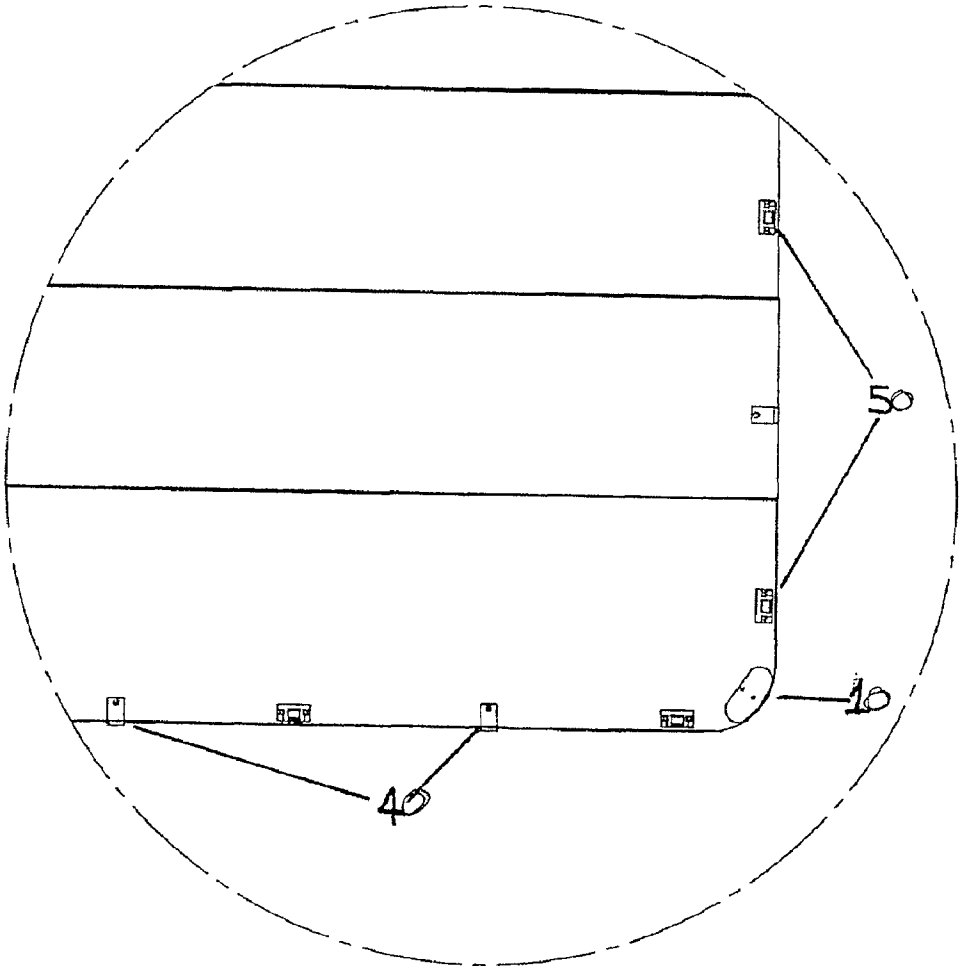
FIG. 4 depicts an exemplary lower corner configuration of a frame and substrate apparatus suitable for use with a cable tensioning system in accordance with aspects described herein.
Figure 5:
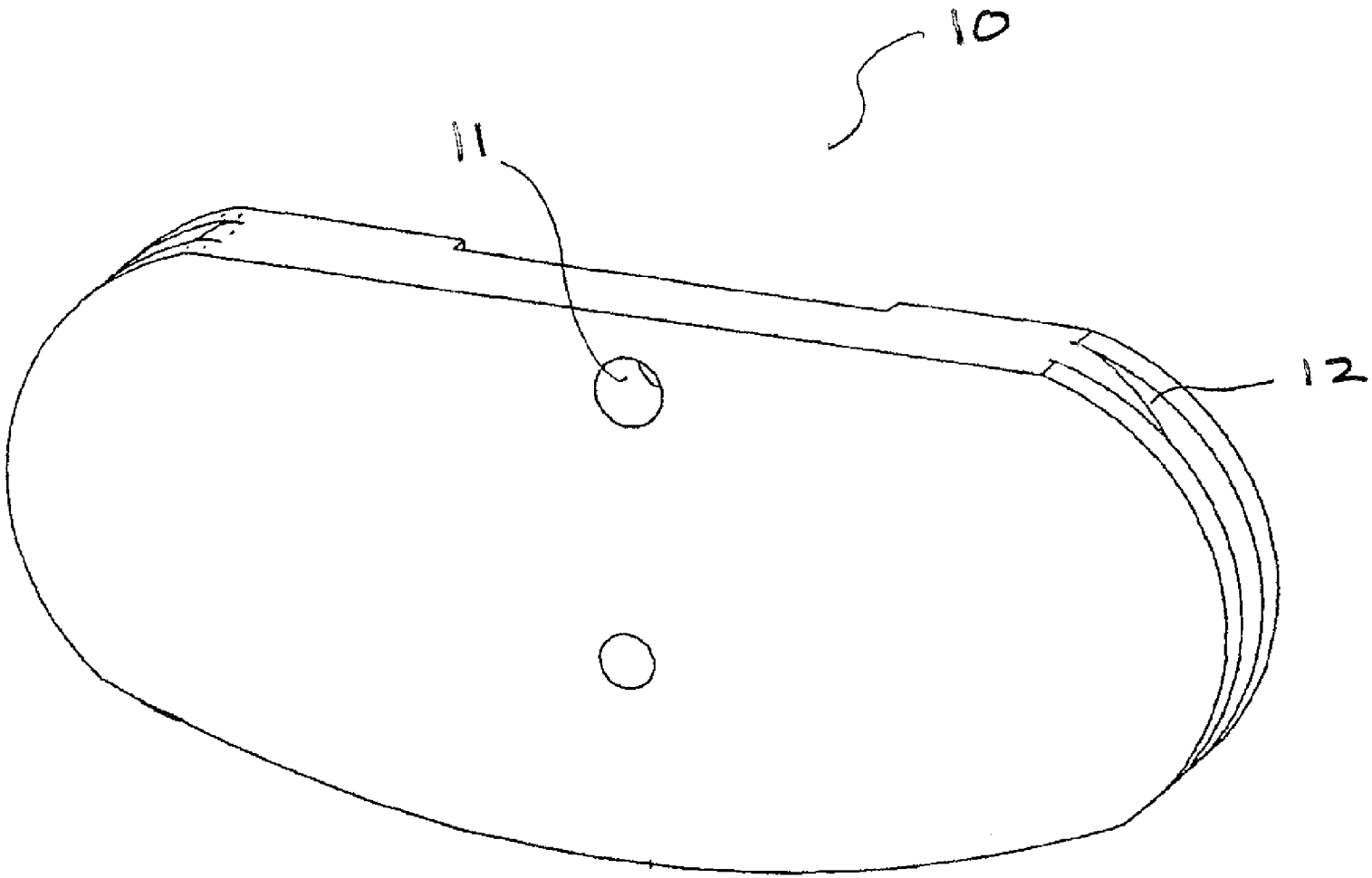
FIG. 5 depicts an exemplary corner cable guide for use in a cable tensioning system in accordance with aspects described herein.

FIG. 4 depicts a more detailed view of another corner of an exemplary frame and apparatus configuration for use with a cable tensioning system in accordance with one or more aspects described herein. As shown in FIG. 4, a cable corner guide 10, shown in more detail in FIG. 5, can be secured at a corner of a rectangular frame by means of fasteners passing through guide holes 11. A cable such as cable 20 shown in FIG. 1 can be guided through channel 12 to travel around a corner so that it can be placed within one or more additional cable guides 40 and locking clips 50 which can continue in a configuration as described above. In accordance with one or more aspects herein, cable 20 can slidably move through channel 12 in corner cable guide 10 when it is tightened through use of spring loaded tension devices 60 so as to enable cable 20 to be securely tightened around the entire perimeter of the frame.

FIGS. 6 and 7 depict exemplary configurations of a flush-mounted cable guide 40A and a right angle-mounted cable guide 40B, respectively, that can be used in a cable tensioning system in accordance with aspects described herein. A flush-mounted cable guide 40A as shown in FIG. 6 can be secured to a front of a substrate supported by a frame as shown in FIGS. 1 and 2 by means of fasteners passing through guide holes 41. Similarly, a right angle-mounted cable guide 40B as shown in FIG. 7 can be placed on top of a frame and can be secured to a front of a substrate by means of a fastener passing through guide hole 41. In accordance with aspects herein, both flush-mounted cable guide 40A shown in FIG. 6 and right angle-mounted cable guide 40B shown in FIG. 7 can receive a cable disposed within channel 42 having a lip 43 at one end and can thus support and guide a cable to travel around a perimeter of a frame. As shown in FIG. 2 and in more detail in FIG. 13, in the case of a cable guide 40 placed at a top edge of a frame, cable 20 can rest on top of channel 42. In the case of a cable guide 40 placed at a side edge of a frame, cable 20 can rest within channel 42. In the case of a cable guide 40 placed at a bottom of a frame, cable 20 can rest within channel 42 and be maintained within the channel by means of lip 43 to travel around the perimeter of the frame within a plurality of cable guides 40 placed around the frame.

Figure 9:
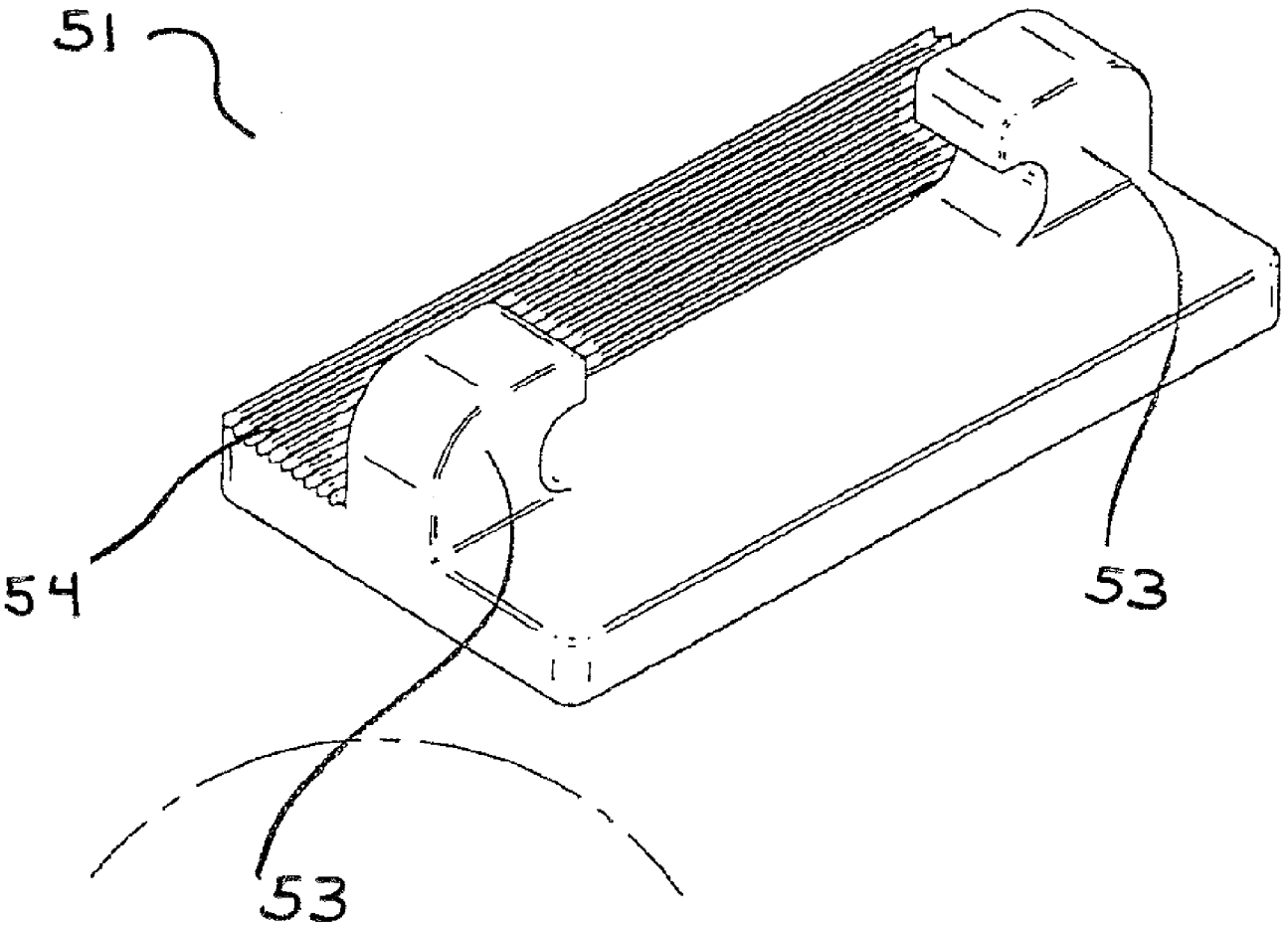
FIG. 9 depicts an exemplary top plate including a cable pull for a two-piece locking clip for use in a cable tensioning system in accordance with aspects described herein.
Figure 10:
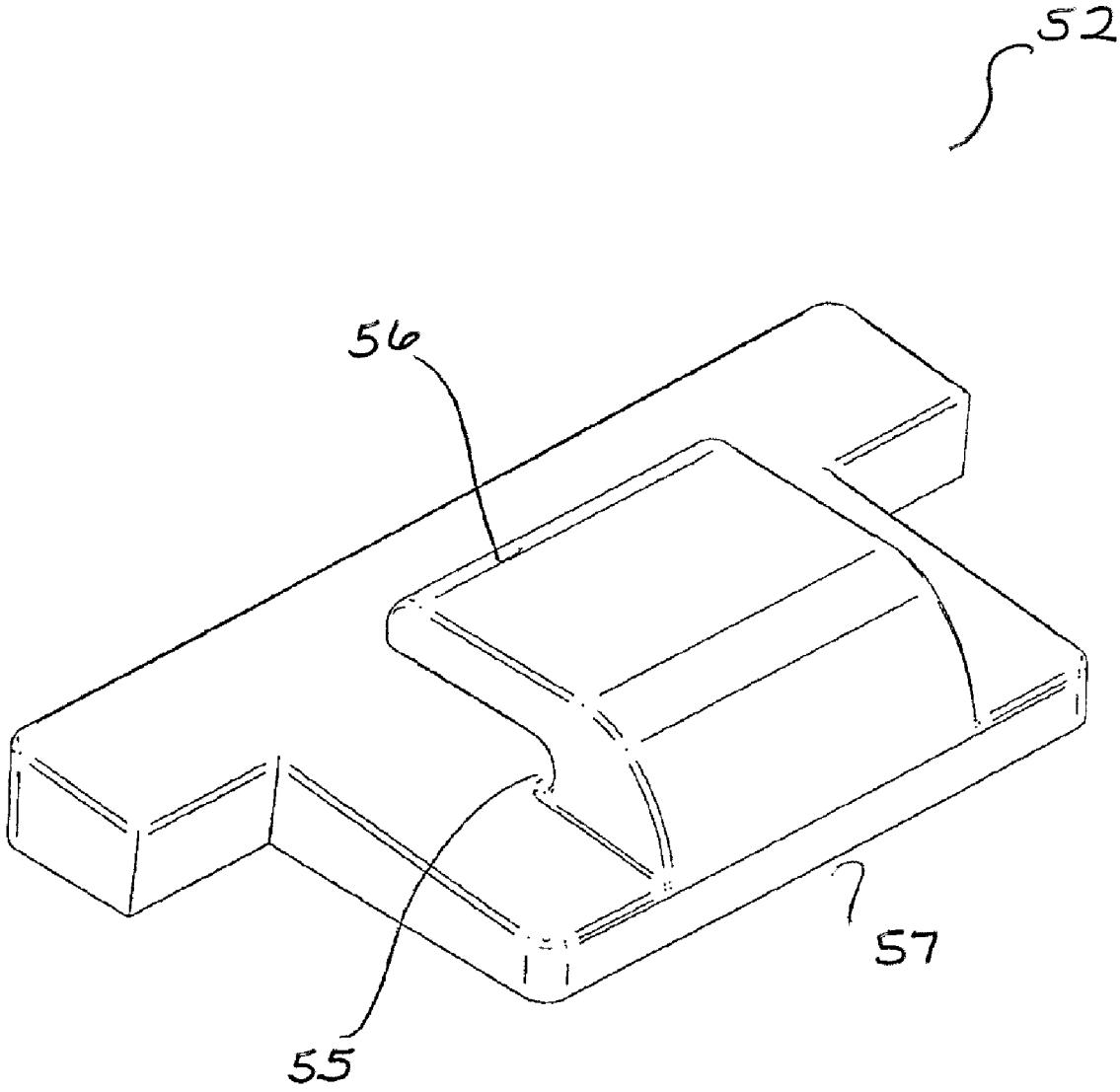
FIG. 10 depicts an exemplary two-piece locking clip comprising a base plate and a cable pull top plate for use in a cable tensioning system in accordance with aspects described herein.

FIGS. 8, 9, and 10 depict detailed views of a locking clip 50 and components thereof that can be used in a cable tensioning system in accordance with aspects described herein. As noted above, a detailed description of a locking clip, components thereof, and methods of use thereof can be found in U.S. patent application Ser. No. 12/104,257. As shown in FIG. 8, locking clip 50 comprises a base plate 51 and cable pull top plate 52 configured to fit between tension arms 53 extending from base plate 51. As shown in FIG. 9, base plate 51 can have ridges 54 configured to grip an underside of a piece of sheet medium such as a vinyl sheet placed on top of base plate 51. As further shown in FIG. 9, base plate 51 also can have two tension arms 53 extending on each side of a top portion thereof. Cable pull plate 52 shown in FIG. 10 can have a channel 55 formed between a top surface of cable pull plate 52 and a lip 56. As shown in FIG. 10, a front portion 57 of cable pull plate 52 can be tapered so that front portion 57 can be slidably placed between tension arms 53 on base plate 51.

In accordance with aspects described herein, a piece of sheet medium such as a vinyl sheet can be placed on top of base plate 51 so that ridges 54 can grip a lower surface of the vinyl sheet. Cable pull top plate 52 can then be placed on top of base plate 51 and moved using hand-applied force to place front portion 57 between tensioning arms 53 and lock the locking clip apparatus comprising base plate 51 and cable pull top plate 52 onto the vinyl sheet. In accordance with aspects herein, when a cable is placed within channel 55 and lateral tension applied to the cable, for example, when the cable is tightened by use of one or more spring-loaded tension devices 60, cable pull top plate 52 is moved farther into the space between tensioning arms 53 to securely lock the vinyl sheet between base plate 51 and cable pull top plate 52.

Figure 11:
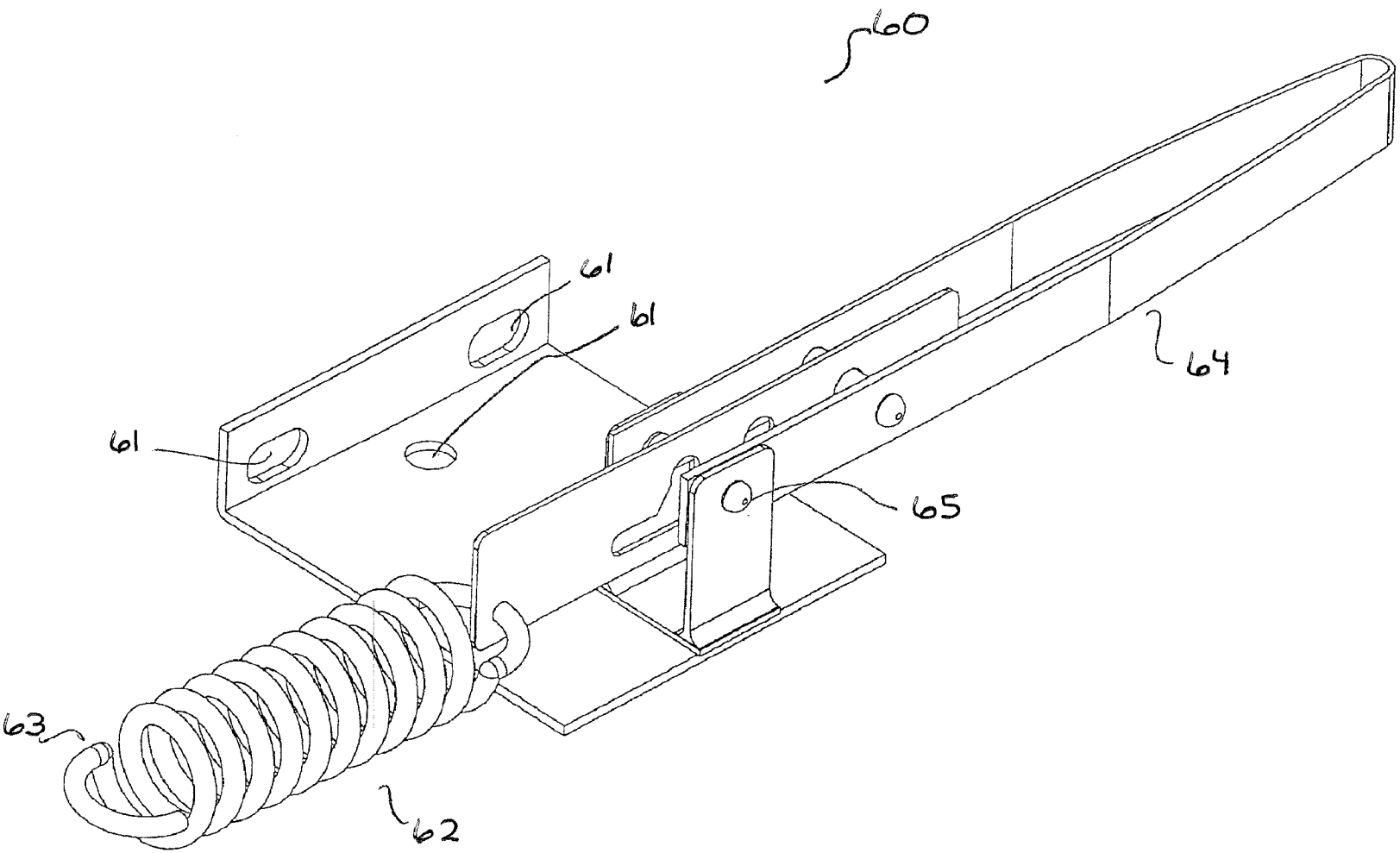
FIG. 11 depicts an exemplary spring-loaded tension device for use in a cable tensioning system in accordance with aspects described herein.

FIG. 11 depicts an exemplary tension device that can be used to apply force to cable 20 in accordance with one or more aspects described herein. As seen in FIG. 11, a tension device 60 is provided that can be fixably mounted to a frame and/or a substrate by means of fasteners passing through guide holes 61. In the configuration shown in FIG. 1, a spring 62 is provided which creates tension when force is applied to extend the spring beyond its equilibrium length. In accordance with aspects described herein, a free end 63 of spring 62 can be attached to cable 20, with the other end being attached to lever 64 which can rotate around a pivot point 65. As lever 64 is rotated around pivot point 65, it can act to extend spring 62 beyond its equilibrium length, thus creating tension on cable 20 attached to free end 63. In accordance with one or more aspects, lever 64 can have a conventional locking mechanism so that when it reaches a point of maximum tension, it can be locked into place, thus holding cable 20 under the tension so created. In a cable tensioning system in accordance with aspects described herein and as shown in FIG. 2, two spring loaded tension devices 60 can be used to apply tension on each of two cables 20 traveling in opposite directions around a frame. In an exemplary configuration shown in FIG. 2, a first cable 20A traveling in a first direction can be attached to a free end 63 of a spring 62 in spring loaded tension device 60B, and a second cable 20B traveling in a second direction opposite to the first direction can be attached to a free end 63 of a spring 62 in spring loaded tension device 60A so as to maximize the tension on each of cables 20A and 20B when levers 64 are fully extended.

As described above, FIG. 12 depicts a cable anchor plate 70 that can be used in a cable tensioning system in accordance with aspects herein. The cable anchor plate 70 can be fixably secured to a corner of a frame supporting a substrate (if a substrate is present) by means of one or more fasteners extending through guide holes 71. In accordance with one or more aspects herein, each of two cables 20 can be secured within an opening 72 in cable anchor plate 70 to provide a point from which tension on cable 20 can be applied by means of spring loaded tension device 60.

Figure 13:
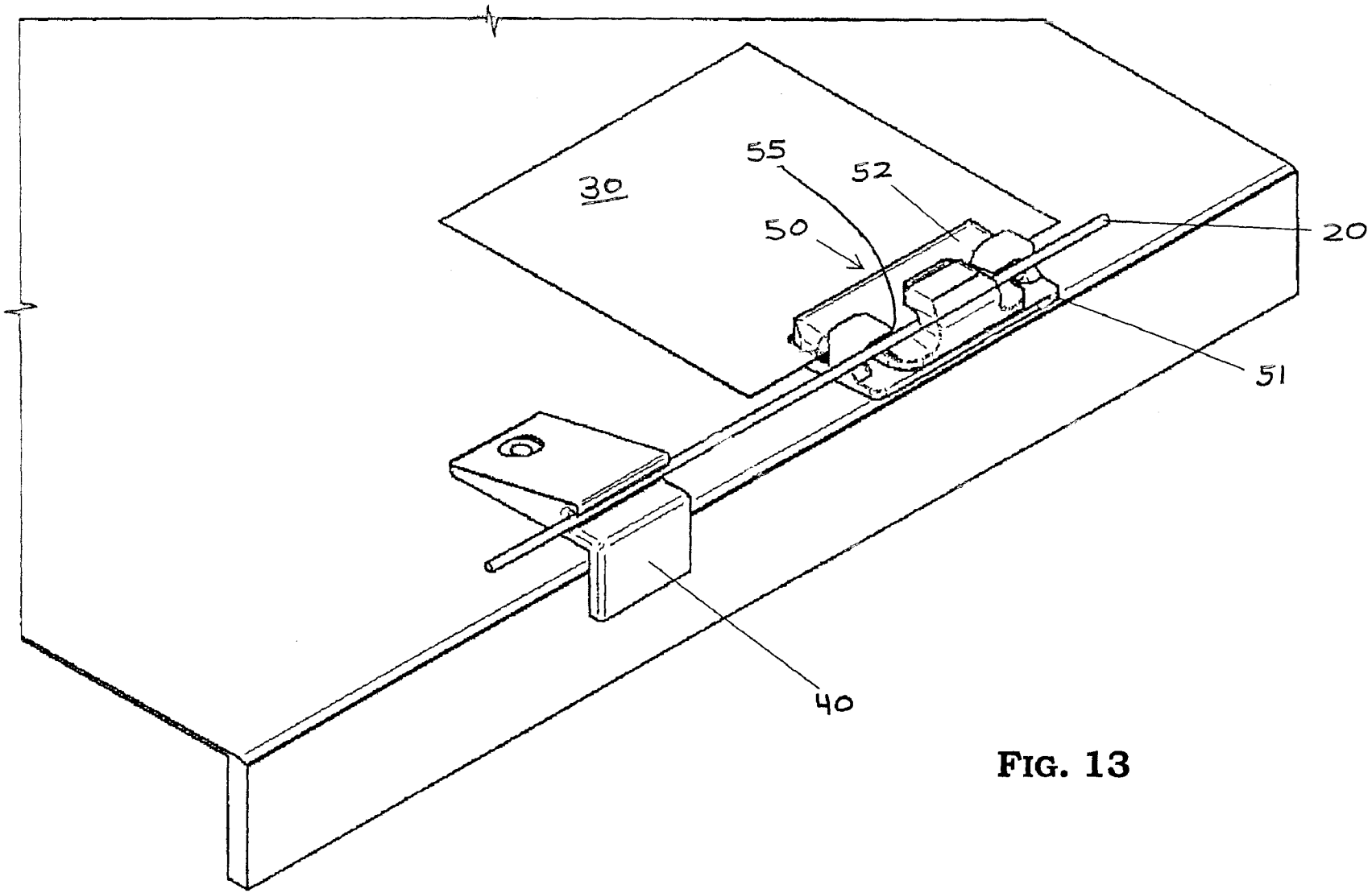
FIG. 13 depicts an exemplary configuration of a cable guide and a locking clip used in a cable tensioning system in accordance with aspects described herein.

FIG. 13 depicts an exemplary configuration of a cable 20, locking clip 50, and cable guide 40 in accordance with aspects described herein. In the exemplary configuration shown in FIG. 13, a locking clip 50 having a base plate 51 and cable pull top plate 52 holds a flat sheet of medium such as a flat vinyl sheet 30. A top portion of cable pull top plate 52 shown in FIG. 13 is disposed between tensioning arms 53 of base plate 51 so that a front portion 57 is between the tensioning arms. Lip 56 forms a channel 55 so that as illustrated in the exemplary configuration shown in FIG. 13, locking clip 50 holding vinyl sheet 30 rests on top of cable 20 with cable 20 resting within channel 55 and on top of tensioning arms 53. A right angle-mounted cable guide 40B is mounted onto a substrate (if a substrate is present) and cable 20 rests within channel 42 in cable guide 40B. In accordance with aspects herein, when lateral tension is applied to cable 20, cable pull top plate 52 is pulled upward between tensioning arms 53 so that vinyl sheet 30 is securely held between cable anchor base plate 51 having gripper ridges 54 and cable pull top plate 52 so that it can be securely mounted to the frame and the substrate.

In accordance with one or more aspects herein, a system for mounting a piece of flat sheet medium such as a billboard comprising a vinyl sheet having printed information thereon is provided which utilizes a cable tensioning system having components as described above. In accordance with aspects herein and as described above, a plurality of locking clips 50 can be affixed to a perimeter of a flat vinyl sheet 30, typically in a uniform manner each being two to three feet apart along the edges of the sheet. Due to the combined presence of ridges 54 and tensioning arms 53 on the base plate 51 and the tapered front end 57 of cable pull top plate 52 being disposed between tensioning arms 53 as described above, the vinyl sheet 3 can be securely held within the locking clip 5 without the need to fold, weld, or specially treat the sheet to allow for a mounting device, thus resulting in savings of time and labor needed to create each vinyl billboard. The plurality of locking clips can be applied off-site, for example, while vinyl sheet 30 is in a shop, indoors and out of the weather. The vinyl sheet 30 with the locking clips 50 attached can then be rolled, folded, or otherwise placed into a smaller, more compact configuration for transport to the billboard site. Alternatively, locking clips 50 can be applied to vinyl sheet 30 on-site, for example, so that the clips can be spaced in accordance with a configuration of channel guides on the frame and substrate.

Once at the site, vinyl sheet 30 with locking clips 50 attached can be unrolled or unfolded, and using a long pole having a hook at a distal end thereof, can be lifted so that cable 20 is situated within channel 55 of each locking clip. For example, in the case of clips at a top edge of a frame, channel 55 can rest on top of cable 20; alternatively, cable 20 can rest within channel 55 in the case of clips along vertical sides and a bottom of the frame. In either case, as seen in FIG. 13, cable 20 also can rest along a top edge of tensioning arms 53. In an exemplary configuration as shown in FIGS. 2 and 13, each locking clip 50 can alternate with a cable guide 40 so that cable 20 is securely guided around the entire perimeter of the billboard frame. As seen in FIG. 2, when the vinyl sheet 30 has been completely mounted onto the frame, each locking clip 50 can secure and guide cable 20 within its respective channel 55, with additional guidance of cable 20 being provided by cable guides 40 and one or more corner cable guides 10. Once cable 20 has been placed within all corner cable guides 10, cable guides 40, and channels 55 in locking clips 50, tension can be applied to cable 20 by means of spring-loaded tension device 60. When levers 64 of spring-loaded tension device 60 are deployed, transverse force can be applied to cable 20 uniformly along its length. This force can cause the front end of each of locking clips 50 to move more securely within tensioning arms 53, either by causing the top of channel 55 to move relatively upward as in the case of locking clips at a top of the frame, or by causing tensioning arms 53 be moved relatively downward. In this manner, cable 20, locking clips 50, cable guides 40, and spring-loaded tension devices 60 can cause vinyl sheet 30 to create a flat, secure, and undistorted display on the face of the billboard.

While the various aspects of the invention have been described in conjunction with the example structures and methods described above, various alternatives, modifications, variations, improvements and/or substantial equivalents, whether known or may be presently unforeseen, may become apparent to those having at least ordinary skill in the art. Accordingly, the example structures and methods, as set forth above, are intended to be illustrative of the invention, not limiting it. Various changes may be made without departing from the spirit and scope of the invention. Therefore, the invention is intended to embrace all known or later developed alternatives, modifications, variations, improvements and/or substantial equivalents.

All patents, patent applications and publications referred to herein are incorporated by reference in their entirety.

What is claimed is:

1. A cable tensioning system for mounting a substantially flat medium to a frame, comprising:

a) a single cable having a first end and a second end, the cable being secured at the first end at a point on the frame;

b) a plurality of cable guides being situated at intervals around the perimeter of the frame, each of the cable guides having a guide channel adapted to receive the cable therein;

c) a plurality of locking clips, each clip including a base plate and a top plate and being adapted to secure an edge of a substantially flat medium between the base plate and the top plate, each clip further having a guide channel adapted to receive the cable therein; and d) a cable tensioning device including a spring, a first end of the spring being adapted to receive the second end of the cable and a second end of the spring being attached to a lever traveling around a pivot point so that when the lever is deployed the spring is extended beyond its equilibrium length so as to apply uniform lateral tension on the cable around the perimeter of the frame.

2. The cable tensioning system of claim 1, wherein the base plate further comprises a plurality of gripping protrusions at one end of a top surface thereof, the gripping protrusions being adapted to grip an underside of the substantially flat medium and further including two tensioning arms at an opposite end of the top surface thereof, the tensioning arms being adapted to receive a front end of the top plate.

3. The cable tension system of claim 1, wherein the top plate further comprises a lip protruding from a top surface thereof to form the channel adapted to receive the cable and further including a tapered front end thereof, the tapered front end being adapted to fit between the tensioning arms of the base plate and being further adapted to slidably move between the tensioning arms.

4. The cable tensioning system of claim 1, wherein a substantially flat medium is secured between a plurality of the locking clips placed at intervals around a perimeter of the medium;

further wherein the flat medium is mounted to the frame such that the cable is secured within the plurality of locking clips and the plurality of cable guides; and further wherein the deployment of the cable tensioning device causes the cable to become tightened to securely mount the flat medium to the frame.

5. The cable tensioning system of claim 1, wherein the frame is substantially rectangular, and further comprising a corner cable guide situated at a corner of the rectangular frame, the corner cable guide being configured to further secure and guide the cable around the perimeter of the frame.

6. A billboard system, comprising:

a) a frame mounted on a support;

b) a substrate situated within a perimeter of the frame;

c) a substantially flat medium having printing on a top side thereof, d) a single cable having a first end and a second end, the cable being secured at the first end at a point on the frame;

e) a plurality of cable guides secured to the substrate at intervals around the perimeter of the frame, each of the cable guides having a guide channel adapted to receive the cable therein;

f) a plurality of locking clips including a base plate and a top plate wherein an edge of the substantially flat medium is secured between the base plate and the top plate, each of the locking clips further having a guide channel adapted to receive the cable therein; and g) a cable tensioning device including a spring, a first end of the spring being adapted to receive the second end of the cable and a second end of the spring being attached to a lever traveling around a pivot point so that when the lever is deployed the spring is extended beyond its equilibrium length so as to apply uniform lateral tension on the cable around the perimeter of the frame;

wherein the flat medium is mounted to the frame such that the cable is secured within the guide channels of the plurality of locking clips and the plurality of cable guides; and further wherein the deployment of the cable tensioning device causes the cable to become tightened within the guide channels of the plurality of the cable guides and the locking clips to securely affix the substantially flat medium to the frame.

7. The billboard system of claim 6, wherein a top surface of the bottom plate of the locking clip includes a plurality of protrusions adapted to grip an underside of the substantially flat medium and further includes two tensioning arms at an end opposite the gripping protrusions;

and further wherein the top plate of the locking clip has a tapered front end adapted to fit within the two tensioning arms on the bottom plate;

wherein deployment of the cable tensioning device causes the tapered front end of the locking clip to slidably move within the tensioning arms to increase a grip of the locking clip on the substantially flat medium.

8. The billboard system of claim 7, wherein deployment of the cable tensioning device uniformly causes the tapered front end of each of the plurality of locking clips to move within the respective tensioning arms on the bottom plate of each of the plurality of locking clips to result in a display of the substantially flat medium which is substantially flat, secure, and undistorted.

9. The billboard system of claim 7, wherein the substantially flat medium comprises a vinyl sheet.

10. A method for mounting a substantially flat medium to a frame, comprising:

a) providing a single cable having a first end and a second end, the cable being secured at the first end at a point on the frame;

b) providing a plurality of cable guides being situated at intervals around the perimeter of the frame, each of the cable guides having a guide channel adapted to receive the cable therein;

c) providing a plurality of locking clips, each clip including a base plate and a top plate and being adapted to secure an edge of the substantially flat medium between the base plate and the top plate, each locking clip further having a guide channel adapted to receive the cable therein;

(d) providing a cable tensioning device including a spring, a first end of the spring being adapted to receive the second end of the cable and a second end of the spring being attached to a lever pivotable around a pivot point so that when the lever is deployed the spring is extended beyond its equilibrium length so as to apply uniform in lateral tension on the cable around the perimeter of the frame;

d) affixing the plurality of locking clips to an edge of the substantially flat medium to secure the edge within the plurality of locking clips;

e) placing the substantially flat medium with affixed locking clips on the frame having the cable affixed thereto, wherein the cable is secured within the channel on the plurality of locking clips, the cable being further secured within a channel of at least one of a channel guide and a channel corner guide affixed to the frame; and, f) uniformly applying tension to the cable by pivoting the lever to apply lateral tension to the cable and to increase a grip of each of the locking clips on the substantially flat medium to secure the substantially flat medium to the frame.

11. A cable tensioning system for mounting a substantially flat medium to a frame, comprising:

a) a single cable having a first end and a second end, the cable being secured at the first end at a point on the frame;

b) a plurality of cable guides being situated at intervals around the perimeter of the frame, each of the cable guides having a guide channel adapted to receive the cable therein;

c) a plurality of locking clips, each clip including i. a base plate having 1) a top surface having a plurality of surface irregularities, 2) a bottom surface, 3) a front edge and a rear edge, and 4) a pair of opposing tensioning arms extending from said top surface, and ii. a top plate engageable by said tensioning arms and having 1) a top plate top surface, 2) a bottom surface, 3) a front edge and a rear edge, the thickness of at least a portion of said top plate tapering from said front edge toward said rear edge, and 4) a lip extending from said top plate top surface proximate to said rear edge, whereby said tensioning arms and said lip define a channel which can removably accommodate a portion of a cable; and d) a cable tensioning device including a spring, a first end of the spring being adapted to receive the second end of the cable and a second end of the spring being attached to a lever traveling around a pivot point so that when the lever is deployed the spring is extended beyond its equilibrium length so as to apply uniform lateral tension on the cable around the perimeter of the frame.

* * * * *